United States Patent [19]

Verberne et al.

[11] 4,428,803

[45] Jan. 31, 1984

[54] BATHS AND PROCESSES FOR ELECTRODEPOSITING ALLOYS OF COLBALT, TIN AND/OR ZINC

[75] Inventors: Wim M. J. C. Verberne, GT 's-Hertogenbosch; Adriana G. M. Eggels, Tilburg, both of Netherlands

[73] Assignee: OMI International Corporation, Warren, Mich.

[21] Appl. No.: 348,374

[22] Filed: Feb. 12, 1982

[51] Int. Cl.[3] ..... C25D 3/56; C25D 3/60

[52] U.S. Cl. ..... 204/43 Z; 204/43 S

[58] Field of Search ..... 204/43 Z, 43 S, 123, 204/43 T

[56] References Cited

U.S. PATENT DOCUMENTS

| | | | |
|---|---|---|---|
| 3,772,168 | 11/1973 | Dillenberg | 204/43 S |
| 4,035,249 | 7/1977 | Wieczerniak | 204/43 S |
| 4,299,671 | 11/1981 | Tremmel et al. | 204/35 R |

*Primary Examiner*—G. L. Kaplan

*Attorney, Agent, or Firm*—Richard P. Mueller

[57] ABSTRACT

The present invention is based on the discovery that addition of certain amino alcohol compounds enhance the brightening of deposits incorporating tin and cobalt or zinc and improve the process, rendering it capable of producing good deposits with less careful control on the thickness of the coating being required.

According to the present invention a bath composition for electroplating a bright alloy deposit of cobalt and tin or cobalt and zinc on a substrate, is characterized by the present of a brightening amount of a compound having the formula:

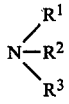

wherein:

$R^1$ represents an alkyl group having 1 to Y carbon atoms or an alkyl group having from 1 to Y carbon atoms at least one of which is substituted by a hydroxyl group; and $R^2$ or $R^3$ or both represent a hydrogen atom or an alkyl group of 1 to Y carbon atoms or an alkyl group of 1 to Y carbon atoms at least one of which is substituted by a hydroxyl group or an amino group and $R^2$ and $R^3$ may be the same or different and may be the same as or different to $R^1$, Y being an integer from 2 to 6 and preferably 2, 3 or 4.

6 Claims, No Drawings

BATHS AND PROCESSES FOR ELECTRODEPOSITING ALLOYS OF COLBALT, TIN AND/OR ZINC

The present invention relates to electrodeposition of bright coatings onto metallic substrates, to a bath composition in which such electrodeposition can be carried out and to substrates thus electrocoated.

BACKGROUND OF THE INVENTION

It is known in the art to which this invention pertains to provide upon a suitable substrate nickel and chromium coatings. Particularly with respect to relatively small metal parts, this involves what is termed in the art as "bulk plating," and while it is relatively simple to barrel plate quite small parts such as screws and the like with bright nickel in various types of barrel apparatus, it can be difficult then to chromium plate the nickel plated parts. It is normally necessary that the parts be transferred from the barrel in which they have been nickel plated, and be transferred to special barrels to be chromium plated, which is an expensive operation. Alternatively, if these barrels have too limited capacities, chromium plating has been accomplished in trays. This, however, requires substantial labor and results in an expensive plating cycle.

Our earlier proposal in U.K. patent specification No. 1,497,552 provided a plating bath utilizing a source of nickel ions, cobalt ions, iron ions or mixtures thereof and a source of tin ions and optionally a source of zinc ions together with as a complexing agent a gluconate or glucoheptonate (or mixture thereof). Such baths provide excellent deposits having chromium-like appearance at thicknesses up to 5 microns.

SUMMARY OF THE INVENTION

The present invention is based on the discovery that addition of certain amino alcohol compounds enhance the brightening of such deposits incorporating tin and cobalt or zinc and improve the process, rendering it capable of producing good deposits with less careful control on the thickness of the coating being required.

DETAILED DESCRIPTION OF THE INVENTION

According to the present invention a bath composition for electroplating a bright alloy deposit of cobalt and tin or cobalt and zinc on a substrate, is characterized by the presence of a brightening amount of a compound having the formula:

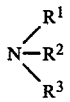

wherein:

$R^1$ represents an alkyl group having 1 to Y carbon atoms or an alkyl group having from 1 to Y carbon atoms at least one of which is substituted by a hydroxyl group; and $R^2$ or $R^3$ or both represent a hydrogen atom or an alkyl group of 1 to Y carbon atoms or an alkyl group of 1 to Y carbon atoms at least one of which is substituted by a hydroxyl group or an amino group and $R^2$ and $R^3$ may be the same or different and may be the same as or different to $R^1$, Y being an integer from 2 to 6 and preferably 2, 3 or 4.

Preferably at least one of $R^1$, $R^2$ or $R^3$ is an alkyl group substituted by a hydroxyl group.

In a preferred form of the invention $R^1$ is the same as $R^2$ and represents a hydrogen atom, or $R^1$ is the same as $R^2$ and represents an alkanol group.

The bath preferably also incorporates a hydroxy carboxylic acid complexing agent for the metal ions in the bath and in particular a gluconate or glucoheptonate.

One preferred form of bath for electrodepositing bright chromium-like cobalt-tin coatings comprises 0.5 to 5 grams per liter of cobalt ions, 0.5 to 5 grams per liter of tin ions, 1 to 20 ml/l of a brightener comprising N-(2-aminoethyl)ethanolamine, monoethanolamine, N-methyl-diethanolamine, triethanolamine or triisopropanolamine and optionally in addition tris-(hydroxymethyl)aminomethane, and 1 to 50 g/l of gluconate or glucoheptonate ions.

Another preferred form of bath for electrodepositing bright chromium-like cobalt-zinc coatings comprises 0.5 to 10 grams per liter of cobalt ions, 0.5 to 20 grams per liter of zinc ions, 1 to 20 ml/l of brightener comprising triethanolamine, N-(2-aminoethyl) ethanolamine, tris-(hydroxymethyl)aminomethane or triisopropylamine, and 1 to 100 g/l of gluconate or glucoheptonate ions.

The bath is preferably also free of ammonia or ammonium ions since these have been found to cause haziness in the deposit.

The invention thus also extends to an electrodeposition process for depositing bright chromium-like deposits of cobalt-tin or cobalt-zinc alloys by contacting the surface to be plated as the cathode with a bath according to the invention and passing an electroplating current therethrough.

Preferred plating conditions are 25° to 35° C., medium mechanical agitation, pH 8.3 to 9.0 and a current density of 0.5 to 1.0 A/dm$^2$.

A further preferred step in the process is to submit the chromium-like coating to a passivation step and this is particularly useful with the cobalt-zinc deposits since it protects them against discoloration on exposure to elevated temperatures and to fingerprint marking.

Preferred passivation agents are a 1% phosphoric acid solution or a 7 g/l $CrO_3$ solution.

The invention thus also extends to a passivated cobalt-zinc electrodeposit especially when made by a process in accordance with the invention.

The substrate upon which the electroplating is to be accomplished is generally a metallic surface such as brass, steel, or a zinc casting, or may be a polymeric substance such as acrylo-nitrile-butadiene-styrene, polyethylene, polypropylene, polyvinyl chloride or phenol-formaldehyde polymer which has been electroless plated prior to coating with the chromium-simulating electrodeposited layer.

To be more specific, the metal-bearing substrate may be plated with a metallic layer from an aqueous solution which comprises 0.5 to 10 grams per liter of a source of cobalt ions, and more preferably, 0.5 to 5 grams per liter of a source of cobalt ions, and most preferably 1.5 to 3 grams/liter.

As to the tin ions, those are preferably in the stannous phase and may be present in an amount between 0.5 and 5 grams per liter, more preferably 1 to 5 grams per liter.

The hydroxy carboxylic acid complexing agent, e.g. the gluconate or glucoheptonate, or mixtures thereof, may be present in an amount of from 1 to 50 grams per liter and more specifically, 5 or 10 to 30 grams per liter.

However, in order to further improve the color and luster of the electrodeposited coating a source of zinc ions may be substituted in part for the source of tin ions. The source of zinc ions may be present in an amount of 1.0 to 4.0 grams per liter, and more preferably 2.0 to 3.0 grams per liter.

It is important to note at this point that the use of gluconate or glucoheptonate as the complexing agent is superior to the use, for example, of other complexing agents such as citrate in that the stability of the solution is distinctly better with gluconate or glucoheptonate. In addition, the appearance of the electrodeposit and coating which deposited from a solution containing gluconate or glucoheptonate is distinctly superior in uniformity and color as compared to the use of other complexing agents.

SPECIFIC EXAMPLES

The invention may be put into practice in various ways and a number of specific embodiments will be described to illustrate the invention with reference to the accompanying examples in which all parts and percentages are by weight unless otherwise stated.

Examples 1 to 5 are examples of zinc cobalt plating processes.

EXAMPLE 1

A bath A was made up having the following composition:

| | Concentration |
|---|---|
| Ingredient | |
| Cobalt sulphate $CoSO_4.6H_2O$ | 20.0 g/l |
| Zinc sulphate $ZnSO_4.7H_2O$ | 7.5 g/l |
| Complexing agent | |
| Citric acid | 40.0 g/l |
| pH (adjusted with ammonia) | 8.3 |

Plating tests with this bath A in a Hull cell using steel J panels were carried out at 1 A/dm$^2$ for 10 minutes at a temperature of 27° C., agitation being by a magnetic stirrer at constant speed. The deposit was chromium coloured and had a bright low current density area and a milky high current density area.

The procedure was repeated at 6 g/l of zinc sulphate and 0.5 A/dm$^2$ at a pH of 8.5 using 3.5 liters in a 4 liter stainless steel beaker as the anode. The deposit was uneven through chromium coloured and had brown spots and was hazy (this being revealed by microscopic examination to be due to small pits).

Analysis of the deposit revealed a zinc content of 55% and a plating efficiency of 28%.

EXAMPLE 2.A

Example 1 was repeated but sodium hydroxide was used to adjust the pH instead of ammonia.

The resultant deposits, although uneven and dark, were free of any haziness or pitting.

EXAMPLE 2.B

Example 2.A was repeated but with 30 g/l of zinc sulphate. This produced a deposit of chrome-like colour although the low and high current density areas were dull.

EXAMPLE 3

Example 2.B was repeated but with the addition of 4 ml/l of triethanolamine.

The deposit was completely bright though there were a few dark spots in the medium current density area.

EXAMPLE 4.A

A bath B was made up having the following composition:

| | Concentration |
|---|---|
| Ingredient | |
| Cobalt sulphate $CoSO_4.6H_2O$ | 20.0 g/l |
| Zinc sulphate $ZnSO_4.7H_2O$ | 40.0 g/l |
| Complexing agent | |
| Sodium glucoheptonate | 60.0 g/l |
| pH (adjusted with NaOH) | 8.3 |

When the procedure of Example 1 was repeated this produced a completely grey panel.

EXAMPLE 4.B

Example 4A was repeated with the addition of 4 ml/l of triethanolamine.

The deposit was a perfect chromium-like deposit.

EXAMPLES 4.C TO 4.0

These were all based on the bath of Example 4.B above, the variations being in zinc concentration, current density, agitation, pH and temperature, and details being given in Table 1.

3 liters of solution were plated in a 4 liter stainless steel beaker as the anode using straight steel panels as the cathodes and a mechanical magnetic stirrer.

TABLE 1A

| Example | Zinc Sulphate conc. g/l | Current density A/dm$^2$ | Agitation | pH | Temperature °C. |
|---|---|---|---|---|---|
| 4.C | 35 | 0.5 | mild | 8.3 | 27 |
| 4.D | 40 | " | " | " | " |
| 4.E | " | 1 | " | " | " |
| 4.F | " | 2 | " | " | " |
| 4.G | " | 0.5 | " | 9.3 | " |
| 4.H | " | " | " | 7.6 | " |
| 4.I | 45 | " | " | 8.3 | " |
| 4.J | " | " | " | " | 50 |
| 4.K | " | " | high | " | 27 |
| 4.L | " | " | mild | " | 50 |
| 4.M | 50 | " | " | " | 27 |
| 4.N | 55 | " | " | " | " |
| 4.O | 60 | " | " | " | " |

TABLE 1B

| Example | % Zn in deposit % | Efficiency % | Appearance |
|---|---|---|---|
| 4.C | 79 | 16 | bright chrome-like |
| 4.D | 82 | 24 | bright chrome-like |
| 4.F | 78.5 | 13.5 | bright chrome-like slight burning in HCD areas |
| 4.G | 83 | 20 | bright chrome-like |
| 4.H | 81.5 | 61 | grey edges |
| 4.I | — | 25 | bright chrome-like |
| 4.J | 82 | 50 | bright chrome-like but a grey streak |

TABLE 1B-continued

| Example | % Zn in deposit % | Efficiency % | Appearance |
|---|---|---|---|
| | | | in the middle |
| 4.K | — | — | bright chrome-like paler colour in the centre |
| 4.L | 82.5 | — | good appearance |
| 4.M | 83.5 | 24 | bright chrome-like |
| 4.N | 85 | 29 | grey streak in centre |
| 4.O | 86.5 | 34 | grey |

As can be seen from these examples 1 to 4.0 glucoheptonic acid and its salts give better results than citric acid and pH adjustment with sodium hydroxide gives better results than adjustment with ammonia.

It is to be noted that the baths of Examples 2.A to 4.0 are ammonia free.

Preferred bath compositions in accordance with the invention thus comprise 20 g/l cobalt sulphate, 35 to 50 g/l zinc sulphate, 60 g/l sodium glucoheptonate, 4 ml/l of triethanolamine, pH 8.3 to 9.5, temperature 27° to 50° C., the bath being ammonia free and pH adjustment preferably being carried out by use of sodium hydroxide.

This produce excellent chromium-like deposits, the colour of which is very reproducible being little effected by zinc content, pH variation or temperature variation within the ranges given.

The process is also cheaper than one based on tin-cobalt deposits.

We have also found that the surface can be made resistant to discolouration by fingerprints and deterioration in appearance on storing at elevated temperatures by means of a passivation process as described in Example 5 below.

EXAMPLE 5

Panels from Examples 4.A to 4.0 were selected in trios and one was left untreated as a control (Example 5A) another was passivated by immersion for 1 minute in a 1% phosphoric acid solution (which turned the deposit slightly darker) (Example 5B) and the third panel was passivated by immersion for 1 minute in a 7 g/l $CrO_3$ solution (which did not affect the appearance of the panel (Example 5C).

Each panel than had a fingerprint impressed on it and the panels were all stored in an oven at 220° C. After 16 hours the 5A panels clearly showed the fingerprint and a greyish discolouration. The 5B and 5C panels did not have the greyish discolouration and the fingerpring was hardly visible.

EXAMPLE 6A

A bath C was made up having the following composition:

| | Concentration |
|---|---|
| Ingredient | |
| Cobalt sulphate $CoSO_4.7H_2O$ (X) | 7.28 g/l |
| Tin sulphate (Y) | 2.42 g/l |
| Sodium sulphate (Z) | 20.7 g/l |
| Complexing agent | |
| Sodium glucoheponate | 12.0 g/l |
| Triethanolamine | 4 ml/l |
| pH (adjusted with NaOH) | 8.3 |

-continued

| | Concentration |
|---|---|
| Temperature | 30° C. |

Straight bright nickel plated steel panels were plated as the cathodes for 10 minutes at 0.5 A/dm$^2$ in 4 liters of bath C contained in a stainless steel beaker as the anode.

The solution was filtered after make up and before plating commenced. Medium agitation was provided by means of a mechanical magnetic stirrer.

The deposit had a good, though dark chromium-like appearance and on analysis was found to contain 71% tin.

The plating efficiency was 32%.

EXAMPLES 6.B TO 6.F

These were all based on bath C in Example 6.A above, the variations being in cobalt (X), tin (Y) and sodium sulphate (Z) contents, pH, temperature, agitation and current density. The results are given in Table 2.

| Example | X | Y | Z | pH | Temp °C. | Agitation | Current density A/dm$^2$ |
|---|---|---|---|---|---|---|---|
| 6.A | 6.28 | 2.42 | 20.70 | 8.3 | 30 | medium | 0.5 |
| 6.B | 7.40 | 3.94 | 20.96 | " | " | " | " |
| 6.C | " | " | " | " | " | none | " |
| 6.D | 7.37 | 3.54 | 20.89 | 9.0 | " | high | " |
| 6.E | 7.44 | 4.50 | 21.06 | 8.3 | " | medium | " |
| 6.F | " | " | " | 9.3 | " | " | " |

TABLE 2B

| Example | Tin content % | Efficiency % | Appearance |
|---|---|---|---|
| 6.A | 71 | 32 | good, dark |
| 6.B | 75 | 47 | good, ligher than Example 6.A. |
| 6.C | 86 | 33 | good, lighter colour than Example 6.B. |
| 6.D | 80 | 54 | good light colour |
| 6.E | 83 | 41 | good |
| 6.F | 89 | 41 | good, lighter than Example 6.E. |

EXAMPLES 7.A TO 7.H

A bath D was made up having the following composition:

| | Concentration |
|---|---|
| Ingredient | |
| Cobalt sulphate $CoSO_4.7H_2O$ (X) | 7.44 g/l |
| Tin sulphate (Y) | 4.5 g/l |
| Sodium sulphate (Z) | 21.06 g/l |
| Complexing agent | |
| Sodium glucoheptonate | 12.0 g/l |
| Monoethanolamine (B) | 0 g/l |
| pH (adjusted with NaOH) | 8.3 |
| Temperature | 25° C. |

Plating was carried out as in Examples 6.A to 6.F and further Examples 7.B to 7.H were carried out in like manner variations being in cobalt (X), tin (Y) and sodium sulphate (Z) and monoethanolamine (B) contents, pH, and current density. The results are given in Table 3.

TABLE 3A

| Example | X | Y | Z | B | pH | Current density A/dm² |
|---|---|---|---|---|---|---|
| 7.A | 7.44 | 4.5 | 21.06 | 0 | 8.3 | 0.5 |
| 7.B | " | " | " | 4 | " | " |
| 7.C | " | " | " | " | 9.0 | " |
| 7.D | 7.50 | 5.3 | 21.20 | 4 | 8.3 | " |
| 7.E | " | " | " | " | 9.0 | " |
| 7.F | " | " | " | " | " | 1.5 |
| 7.G | 7.62 | 6.9 | 22.18 | " | 8.3 | 0.5 |
| 7.H | 7.54 | 5.78 | 21.28 | 8 | 9.0 | 3.0 |

TABLE 3B

| Example | Tin content % | Efficiency % | Appearance |
|---|---|---|---|
| 7.A | 94 | 27 | grey and ugly |
| 7.B | 74 | 27 | dark chrome-like appearance grey edge |
| 7.C | 76 | 21 | looks good, dark |
| 7.D | 75 | 26 | looks good, dark |
| 7.E | 81 | 24 | looks good, lighter than Example 7.D |
| 7.F | — | " | almost completely dull |
| 7.G | 81 | 35 | looks good |
| 7.H | 82 | 19 | looks good |

Consideration of these tables 2 and 3 shows that triethanolamine gives a higher plating efficiency than does monoethanolamine for tin-cobalt deposits.

The colour of the deposit is highly dependent on the tin content in the deposit. Below 80% tin the colour is too dark and above 90% tin grey deposits are formed; at about 85% tin the desired chromium-like colour is produced.

These and further experiments have indicated that for both the mono and triethanolamine systems the effect of raising the concentration of tin in the bath is to produce higher plating efficiency and a lighter colour as well as more tin in the deposit; raising the temperature and agitation also raise efficiency, but increased agitation produces less tin in the deposit and a darker colour; raising current density and pH result in lower efficiency, more tin in the deposit and lighter colour, though the effect of pH on efficiency is less clearly established with triethanolamine than it is with monoethanolamine.

Similar tests to Example 6 conducted with N-(2-aminoethyl)ethanolamine

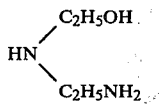

indicate that it has a brightening effect similar to triethanolamine at concentrations in the range 1 to 12 ml/l.

Similarly tris-(hydroxymethyl)aminoethane

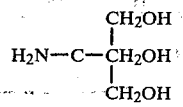

has also been found to have a brightening effect which though not quite as good as triethanolamine is still very useful; it is effective at concentrations in the range 1 to 20 ml/l.

N-methyl-diethanolamine

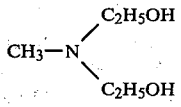

and tri-iso-propanolamine

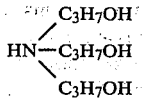

have also been found to have this brightening effect in baths of the type shown in Examples 6 and 7.

Tris(hydroxymethyl)amino-methane when used in zinc-cobalt systems in combination with, N-methyl-diethanolamine, N-(2-aminoethyl)ethanolamine, triethanolamine or tri-isopropanolamine has been found to extend the useful current density range of these materials to higher values. Tris(hydroxymethyl)aminomethane has buffering ability in the range pH 8–9 and this may be the reason for this effect on the current density range of the other compounds. The order of effectiveness of these compounds for tin cobalt systems is as given in this paragraph N-methyl-diethanolamine being the most effective.

For zinc cobalt systems as in Examples 1 to 5 the order of decreasing effectiveness is tri-ethanolamine, N-(2-aminoethyl)ethanolamine, tris(hydroxymethyl-)amino methane, and tri-isopropanolamine.

EXAMPLE 8

The following composition is an example of another bath E in accordance with the invention:

| | Concentration |
|---|---|
| Ingredient | |
| Cobalt sulphate $CoSO_4.6H_2O$ | 7.5 g/l |
| Tin sulphate $SnSO_4.7H_2O$ | 4.5 g/l |
| Sodium sulphate (anhydrous) | 21.0 g/l |
| Complexing agent | |
| Sodium glucoheptonate | 12.0 g/l |
| N—methyl-diethanolamine | 4.0 ml/l |
| pH (adjusted with NaOH or $H_2SO_4$) | 8.3 |
| Temperature | 25° C. |

What is claimed is:

1. A bath composition for electroplating a bright alloy deposit of cobalt and tin or cobalt and zinc on a substrate, comprising cobalt ions, at least one of tin ions and zinc ions, a hydroxy carboxylic acid complexing agent for the metal ions in the bath selected from gluconate and glucoheptonate, and a brightening amount of a compound having the formula:

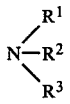

wherein:

$R^1$ represents an alklyl group having 1 to Y carbon atoms or an alklyl group having from 1 to Y carbon atoms at least one of which is substituted by a hydroxyl group; and $R^2$ and $R^3$ or both represent a hydrogen atom or an alkyl group of 1 to Y carbon atoms or an alkyl group of 1 to Y carbon atoms at least one of which is substituted by a hydroxyl group or an amino group and $R^2$ and $R^3$ may be the same or different and may be the same as or different to $R^1$, Y being an integer from 2 to 6, the bath being substantially free of ammonia or ammonium ions.

2. A bath composition as claimed in claim 1 suitable for electrodepositing bright chromium-like cobalt-tin coatings comprising 0.5 to 5 grams per liter of cobalt ions, 0.5 to 5 grams per liter of tin ions, 1 to 20 ml/l of a brightener comprising N-(2-aminoethyl) ethanolamine, monoethanolamine, N-methyl-diethanolamine, triethanolamine or tri-isopropanolamine and 1 to 50 g/l of gluconate or glucoheptonate ions.

3. A bath as claimed in claim 2 which also contains tris-(hydroxymethyl) aminomethane.

4. A bath composition as claimed in claim 1 suitable for electrodepositing bright chromium-like cobalt-zinc coatings comprising 0.5 to 10 grams per liter of cobalt ions, 0.5 to 20 grams per liter of zinc ions, 1 to 20 ml/l of a brightener comprising triethanolamine, N-2(2-aminoethyl) ethanolamine, tris-(hydroxylmethyl) aminomethane or triisopropylamine and 1 to 100 g/l of gluconate or glucoheptonate ions.

5. A bath composition for electroplating a bright alloy deposit of cobalt, tin and zinc on a substrate comprising 0.5 to 10 g/l cobalt ions, tin ions, in the stannous phase, in an amount of from 1 to 5 g/l, zinc ions, in an amount of from 1 to 4 g/l, a hydroxy carboxylic acid complexing agent for the metal ions in the bath, in an amount of from 5 to 30 g/l, and a brightening amount of a compound having the formula:

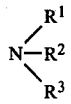

wherein:

$R^1$ represents an alkyl group having 1 to Y carbon atoms or an alkyl group having from 1 to Y carbon atoms at least one of which is substituted by a hydroxyl group; and $R^2$ and $R^3$ or both represent a hydrogen atom or an alkyl group of 1 to Y carbon atoms or an alkyl group of 1 to Y carbon atoms at least one of which is substituted by a hydroxyl group or an amino group and $R^2$ and $R^3$ may be same or different and may be the same as or different to $R^1$, Y being an integer from 2 to 6, the bath being substantially free of ammonia or ammonium ions.

6. An electrodeposition process for depositing bright chromium-like deposits of cobalt-tin or cobalt-zinc alloys by contacting the surface to be plated as the cathode with a bath as claimed in any one of claims 1–5 and passing an electroplating current therethrough.

* * * * *